United States Patent [19]

Bruno

[11] 4,067,066

[45] Jan. 10, 1978

[54] COMBINED BODY GARMENT AND TOTE BAG CONSTRUCTION

[76] Inventor: Wilfred Bruno, 293 E. 38th St., Brooklyn, N.Y. 11203

[21] Appl. No.: 758,261

[22] Filed: Jan. 10, 1977

[51] Int. Cl.[2] ..... A41D 1/22

[52] U.S. Cl. ..... 2/105; 2/69.5; 150/1.7

[58] Field of Search ..... 2/102, 105, 69.5, 69, 2/211; 150/1.7, 11, 1

[56] References Cited

U.S. PATENT DOCUMENTS

| | | | |
|---|---|---|---|
| 3,074,450 | 1/1963 | Wilkaitis et al. | 2/106 |
| 3,633,215 | 1/1972 | Richards | 2/69.5 |

*Primary Examiner*—Werner H. Schroeder

*Assistant Examiner*—Doris L. Troutman

*Attorney, Agent, or Firm*—Cullen, Settle, Sloman & Cantor

[57] ABSTRACT

A body garment adapted to be converted into a tote bag and vice versa, the garment having three panel sections superimposed one upon another, with the front and intermediate panel sections having neck, waist and arm openings and with the back and intermediate panel sections defining a compartment closed at the shoulder end of the garment. With such a construction, a draw cord is carried by the bottom edge portions of the front and rear panel sections for securing the panel sections of the garment about the waist of the wearer. When used as a tote bag, the draw cord provides a constrictable mouth portion between the intermediate and panel sections.

18 Claims, 7 Drawing Figures

FIG. 5
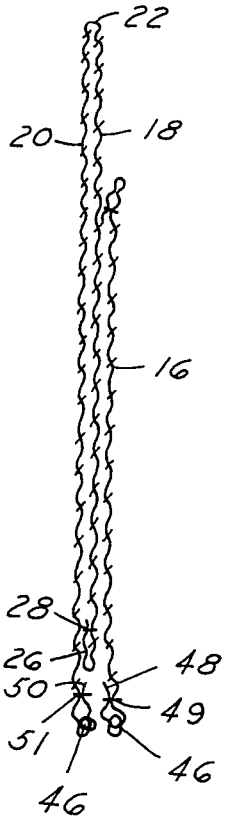
FIG. 7
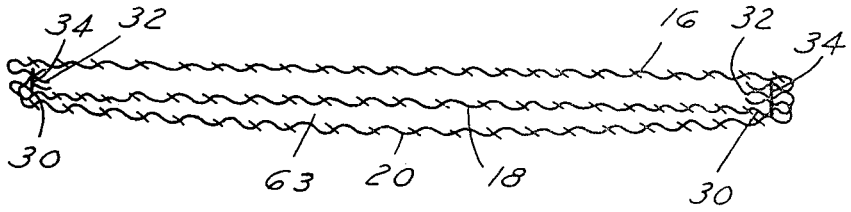
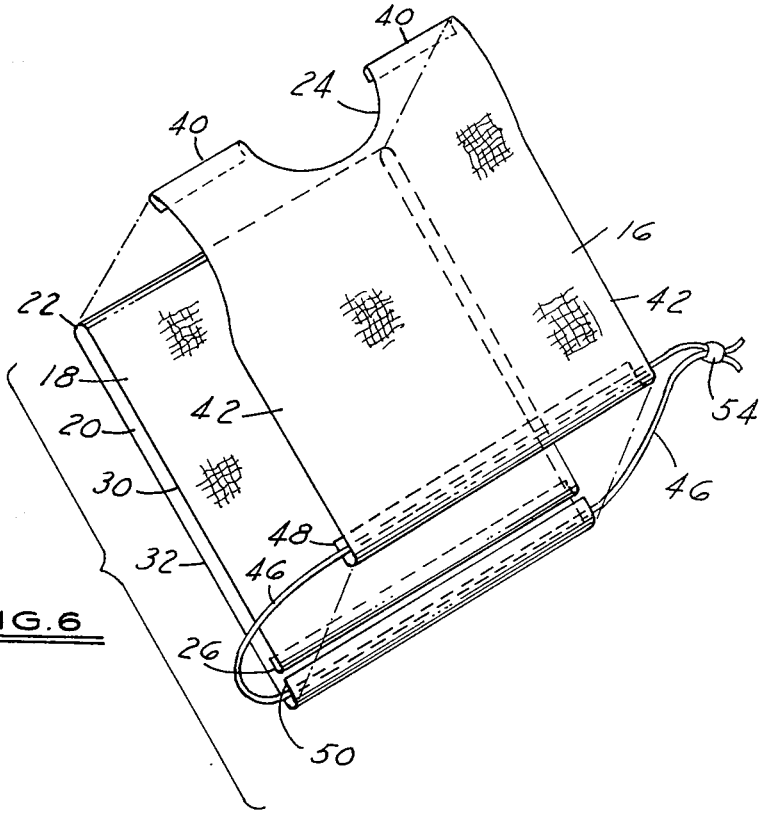
FIG. 6

COMBINED BODY GARMENT AND TOTE BAG CONSTRUCTION

BACKGROUND OF THE PRESENT INVENTION

1. Field of the Invention

The combined body garment and tote bag construction is particularly adaptable for casual wear or use, as an example, when swimming, at the beach, for sporting activities or when a person is casually attired.

2. Description of the Prior Art

A combined body garment and tote bag construction is disclosed in U.S. Pat. No. 3,633,215 entitled "Article of Clothing" which issued to Bernardine J. Richards et al on Jan. 11, 1972 and in U.S. Pat. No. 3,797,043 entitled "Skirt Convertible Into A Tote Bag" which issued to Max Brument on Mar. 19, 1974. In such constructions each garment is provided with draw strings located at the top of the body garments, rather than at the bottom as in the present invention, to fasten around the waist of the wearer. In addition, the body garments disclosed in the aforementioned patents have not been commercially successful since they are deficient in one aspect or another.

Such articles appear overly complex to be well suited for convenient use. Also the manufacturing costs required are too high to make the product economically attractive; and frequently the several uses to which the articles may be placed are not adequately related to one another or to consumer demands to render the articles sufficiently appealing.

Other prior art patents located as a result of a preliminary novelty investigation in the U.S. Patent and Trademark Office are as follows: Nilssen, U.S. Pat. No. 1,497,460 of June 10, 1924; Beltz, U.S. Pat. No. 1,505,530 of Aug. 19, 1924; Mahoney, U.S. Pat. No. 2,079,220 of May 4, 1937; Grady, U.S. Pat. No. 2,315,416 of Mar. 30, 1943; Walsh, U.S. Pat. No. 2,344,010 of Mar. 14, 1944; Hahn, U.S. Pat. No. 2,557,280 of June 19, 1951; Bracken, U.S. Pat. No. 2,678,447 of May 18, 1954; Johnson, U.S. Pat. No. 2,697,465 of Dec. 21, 1954; Jones, U.S. Pat. No. 2,755,480 of July 24, 1956; Kashiyama, U.S. Pat. No. 2,919,443 of Jan. 5, 1960; Allen, U.S. Pat. No. 2,948,898 of Aug. 16, 1960; Fabanich, U.S. Pat. No. 2,967,306 of Jan. 10, 1961; and Vechesloff, U.S. Pat. No. 3,590,864 of July 5, 1971. While the patents illustrate body garments having multiple purposes, none of such garments have the component parts thereof arranged in a highly and efficient manner as in the present invention to provide a body garment which is simple in construction, economical to manufacture, and efficient in operation.

SUMMARY OF THE PRESENT INVENTION

This invention relates to an article of manufacture which can be worn as a body garment or as a T-shirt or used as a tote bag. The article also has additional purposes such that it may be used as a small beach blanket or as a towel or as a pillow when provided with appropriate stuffing.

The combined body garment and tote bag construction may be distributed through stores selling casual beach wear items. After having been used as a tote bag it may thereafter be worn as a body garment. It is to be understood that such a conversion is also possible in the reverse manner. Thus, if the body garment is worn over another apparel such as a bathing suit, it may be removed and converted into use as a beach bag or as a tote bag.

It is a feature of the present invention to provide a body garment adapted to be converted into a tote bag and vice versa comprising first, second and third panel sections superimposed one upon another, with the first and third panel sections forming the front and back panels of the garment and with the first and second panel section being engageable with the front and back respectively of the wearer. With such a construction, the first and second panel sections are provided with neck, waist and arm openings, with each panel section having top and bottom edge portions and side edge portions. Means such as stitches are provided for securing the side and top edge portions of the panel sections and the top edge portions of the panel sections together except for the arm openings and the neck opening. The bottom edge portions of the three panel sections are unattached except by a draw cord. The invention is featured by a draw cord carried by the bottom edge portions of the first and third panel sections for securing the panel sections about the waist of the wearer when used as a body garment. The bottom edge portion of the second panel section is unattached to the first and third panel sections, with the second panel section cooperating with the third panel section to form a tote bag construction which is secured around the top and side edge portions thereof. The draw cord provides a constrictable mouth portion between the second and third panel sections when the garment is converted into a tote bag.

A further feature of the present invention is to provide a garment adapted to be converted into a tote bag wherein the panel sections are of generally rectangular configuration and are made from a cloth fabric material which is washable although it should be understood that other kinds of materials may be used such as textiles and non-woven fabrics.

A still further feature of the present invention is to provide a garment of the aforementioned type wherein the panel sections are made from two separate panels of material, with the second and third panel sections being made from one panel of material which is folded about an intermediate center portion which forms the bottom of the tote bag, and with the other panel of material forming the first panel section.

Another feature of the present invention is to provide a garment of the aforementioned type wherein the appropriate edges of the garments are secured together by stitching, with the panel sections of the garment being made in the same color or from different colors and with the outer panel sections being adapted to carry ornamental designs.

Still another feature of the present invention is to provide a method of making a body garment of the aforementioned type.

BRIEF DESCRIPTION OF THE DRAWINGS

FIG. 5 is a sectional view taken on the line 5—5 of FIG. 3;

FIG. 6 is an exploded view of the various panel sections of the body garment showing the manner in which the panel sections are superimposed one over another; and FIG. 7 is another sectional view taken on the line 7—7 of FIG. 3.

DESCRIPTION OF THE PREFERRED EMBODIMENT

Figure 1:
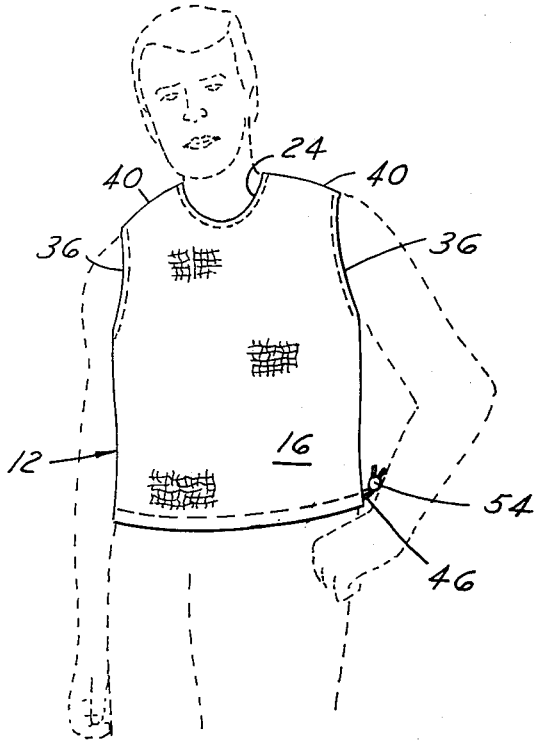
FIG. 1 is a perspective view illustrating the body garment on a wearer.
Figure 2:
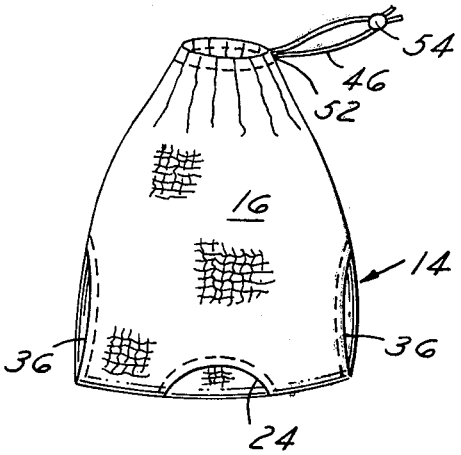
FIG. 2 is a perspective view of the garment utilized as a tote bag.
Figure 3:
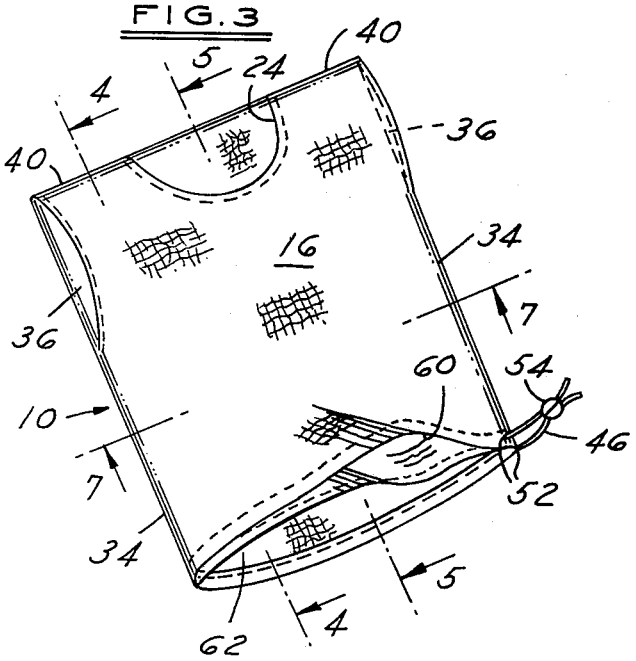
FIG. 3 is a perspective view of the body garment.
Figure 4:
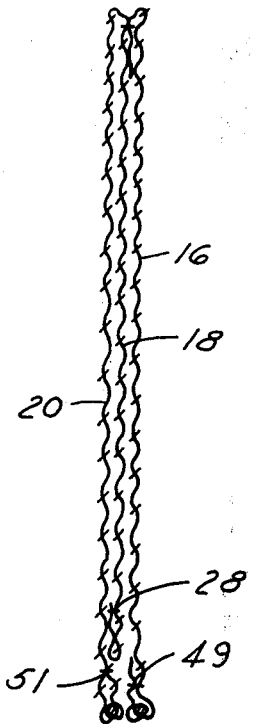
FIG. 4 is a sectional view taken on the line 4—4 of FIG. 3.

The combined body garment and tote bag construction is designated by the numeral 10 in FIGS. 3–7 inclusive; and when used as a body garment or T-shirt on a wearer as in FIG. 1 is designated by the numeral 12. When used as a tote or beach bag as in FIG. 2, it is designated by the numeral 14.

The combined body garment and tote bag construction 10 has three panel sections of generally rectangular configuration as shown in FIG. 6 including a front or first panel section 16, an intermediate or second panel section 18 and a back or third panel section 20. The panel sections 18 and 20 are made from a large panel of material which is folded along area 22 near the intermediate center portion thereof whereby intermediate panel section 18 overlies the back panel section 20. The front panel section is made from a single panel which is secured to the folded second panel as will be subsequently described. It should be understood that the panel sections 18 and 20 may be made from separate panels which are stitched at 22.

The panel sections 16, 18 and 20 are made, as an example, from a washable cloth fabric material or from textiles, non-woven fabrics or from other materials suitable for use as a body garment. The panel sections may be printed in one color or made from different colors.

The front panel section 16 is provided with a neck opening 24 and may be provided with an ornamental design on the outer surface thereof.

In manufacturing, the large panel of material is folded around area 22 as shown in FIG. 6. Thereafter, the bottom edge portion 26 of the intermediate or second panel 18 is folded over and is stitched at 28 (FIG. 5) along the entire length thereof. Thereafter, the side edges 30, 32 of panel sections 18 and 20 respectively are folded at each side thereof and thereafter stitched together at 34 starting at the bottom and terminating a suitable distance form the top of the garment or article 10 to provide the arm openings 36.

The front panel section 16 is then superimposed on the panel section 18 with the outer surface thereof (for the ornamental design) facing the back or outer surface of the rear panel 20. Thereafter the panel section 16 is stitched wrong side out across the shoulders 40 and down the sides 42 except for the neck opening 24 and the arm openings 36 respectively. Thereafter, the body garment or article 10 is turned right side out. The edges or edge portions of the panel sections which are stitched are located within the interior of the garment and cannot be seen when used as a body garment 12 or as a tote bag 14.

A draw cord or string 46 is provided and is associated with the panel sections 16 and 20 as shown in FIG. 6. The bottom edge portion 48 of panel section 16 is folded over the cord 46 and is stitched at 49 from one end thereof to the other end. Also the bottom edge portion 50 of panel section 20 is folded over the cord 46 and is stitched at 51 from one end thereof to the other end. The cord 46 is thus enclosed in a generally endless opening as a result of the stitching of the bottom edge portions 48 and 50, with the garment having single or double slots or openings 52 through which the ends of the cord 52 extend. A conventional slide or keeper 54 is provided at the ends of the cord 46 for adjusting the garment 12 about the waist of the wearer or for closing the opening in the tote bag 14.

The first or front panel section 16 and the third or back panel section 20 from the front and back panels of the garment 12, with the first panel 16 and the intermediate panel 18 being engageable with the front and back sides respectively of the wearer. The bottom edge portions of panel sections 16 and 18 form the waist opening 60 for the wearer.

The second or intermediate panel section 18 and the back or third panel section 20 are permanently secured together around the periphery thereof except at the opening 62 defined by the bottom edge portions 26 and 50. The opening 62 provides a constrictable mouth for the compartment 63 (FIG. 7) forming the tote bag 14. The draw cord 46 may be adjusted to close the opening or mouth 62 of the compartment 63 defined by panel sections 18, 20.

The individual edge portions of the several panels defining the neck opening 24 and arm openings 36 may be folded and stitched. The stitching of the various edge portions is performed on machines. The stitches of each row are continuous or close together thus avoiding any gaps between mating edge portions.

Thus, it can be seen that the present invention provides an article of manufacture and the method of making same which is adapted for a number of uses and is attractive; is of very simple construction; is convenient to use; and is economical to manufacture. Since modifications and changes will readily occur to those skilled in the art, it is not desired to limit the invention to exact construction and operation shown and described, and accordingly all suitable modifications and equivalents may be resorted to, falling with the scope of the invention as claimed.

I claim:

1. In a garment adapted to be converted into a tote bag and vice versa, the combination comprising first, second and third panel sections superimposed one upon another, with said first and third panel sections forming the front and back panels of the garment, with said first and second panel sections being engageable with the front and back respectively of the wearer, said first and second panel sections having neck, waist and arm openings, each panel section having top and bottom edge portions and side edge portions, means securing the side edge portions of said panel sections and the top edge portions of said panel sections together except for said arm openings and said neck opening respectively, the bottom edge portions of said first and third panel sections being unattached to one another, a draw cord carried by the bottom edge portions of said first and third panel sections for securing the panel sections about the waist of the wearer, the bottom edge portion of said second panel section being unattached to said first and third panel sections, with said second panel section cooperating with said third panel section to form a tote bag compartment which is secured around the edge portions thereof except at the bottom edge portions of said second and third panel sections, said draw cord providing a constrictable mouth portion between said second and third panel sections when the garment is converted into the tote bag.

2. In a garment adapted to be converted into a tote bag and vice versa as claimed in claim 1, wherein said panel sections are of generally rectangular configuration and are made from fabric material.

3. In a garment adapted to be converted into a tote bag and vice versa as claimed in claim 1, wherein said panel sections are made from two separate panels of material, with said second and third panel sections being made from one panel of material which is folded about an intermediate center portion which forms the bottom of the tote bag, the other panel of material forming said first panel section.

4. In a garment adapted to be converted into a tote bag and vice versa as claimed in claim 1, wherein the bottom edge portions of said first and third panel sections are folded over the first and third panel sections respectively and secured thereto to form a generally endless opening which receives said draw string.

5. In a garment adapted to be converted into a tote bag and vice versa as claimed in claim 1, wherein said means for securing the side edge portions of said panel sections and the top edge portions of said panel sections together include rows of continuous stitches.

6. In a garment adapted to be converted into a tote bag and vice versa as claimed in claim 1, wherein the bottom edge portion of said second panel section is folded over and secured to said second panel section by a row of continuous stitches.

7. In a garment adapted to be converted into a tote bag and vice versa as claimed in claim 1, wherein the edge portions of the garment forming said neck, waist and arm openings are turned over the respective panel section and secured thereto by rows of continuous stitches.

8. In a garment adapted to be converted into a tote bag and vice versa as claimed in claim 1, wherein said panel sections are made from a washable fabric cloth material.

9. In a garment adapted to be converted into a tote bag and vice versa as claimed in claim 1, wherein the exposed zurface of said first panel section is provided with an ornamental design.

10. In a garment adapted to be converted into a tote bag and vice versa as claimed in claim 1, wherein the exposed surface of said third panel section is provided with an ornamental design.

11. In a garment adapted to be converted into a tote bag and vice versa as claimed in claim 1, wherein the panel sections are of the same color material.

12. In a garment adapted to be converted into a tote bag and vice versa as claimed in claim 1, wherein the first and third panel sections are made from material of different colors.

13. An article of manufacture having multiple uses as a garment, tote bag, blanket, pillow or towel comprising first,, second and third panel sections made from a cloth fabric material and superimposed one upon another, with said first and third panel sections forming the front and back panels, said first and second panel sections having neck, waist and arm openings, each panel section having top and bottom edge portions and side edge portions, means securing the side edge portions of said panel sections and the top edge portions of said panel sections together except for said arm openings and said neck opening respectively, the bottom edge portions of said first and third panel sections being unattached to one another, a draw cord carried by the bottom edge portions of said first and third panel sections, the bottom edge portion of said second panel section being unattached to said first and third panel sections, with said second panel section cooperating with said third panel section to form a compartment which is secured around the edge portions thereof except at the bottom edge portions of said second and third panel sections, said draw cord providing a constrictable mouth portion for said compartment between said second and third panel sections.

14. The article of manufacture as claimed in claim 13, wherein said panel sections are made from two separate panels of material, with said second and third panel sections being made from one panel of material which is folded about an intermediate center portion which forms the bottom of the compartment, the other panel of material forming said first panel section.

15. The article of manufacture as claimed in claim 13, wherein the bottom edge portions of said first and third panel sections are folded over the first and third panel sections respectively and secured thereto to form a generally endless opening which receives said draw string.

16. The article of manufacture as claimed in claim 13, wherein said means for securing the side edge portions of said panel sections and the top edge portions of said panel sections together include rows of continuous stitches.

17. The method of making a body garment provided with neck, waist and arm openings which is adapted to be converted into a tote bag comprising the step of taking a relatively large rectangular panel of cloth material and folding it along an intermediate portion thereof to form a pair of panel sections of generally the same size, securing the side edge portions of the panel sections together, taking a second rectangular panel of cloth material generally equal in size to one of the panel sections and superimposing it over the one panel section, with the normally front surface thereof facing said one panel section, securing the top edge portion of the panel across the shoulders leaving the opening for the neck and along the side edges thereof, securing the panel along the edge portions thereof to the adjacent panel section except for the arm openings; turning said panel right side out to expose the front surface thereof, placing a draw cord around the bottom edge portions of the panel and said other panel section; and turning said bottom edge portions over the cord and securing the edge portions to the respective panel and other panel section, with the ends of the cord extending through an opening in said panel or said other panel section.

18. The method of making a body garment as claimed in claim 17 wherein said edge portions are secured by stitching.

* * * * *